US011073279B2

(12) United States Patent
Qiu et al.

(10) Patent No.: US 11,073,279 B2
(45) Date of Patent: Jul. 27, 2021

(54) MULTI-CONE, MULTI-STAGE SPRAY NOZZLE

(71) Applicant: FISHER CONTROLS INTERNATIONAL LLC, Marshalltown, IA (US)

(72) Inventors: Yan Qiu, Marshalltown, IA (US); Justin Paul Goodwin, Marshalltown, IA (US)

(73) Assignee: FISHER CONTROLS INTERNATIONAL LLC, Marshalltown, IA (US)

( * ) Notice: Subject to any disclaimer, the term of this patent is extended or adjusted under 35 U.S.C. 154(b) by 743 days.

(21) Appl. No.: 15/244,828

(22) Filed: Aug. 23, 2016

(65) Prior Publication Data

US 2018/0058684 A1 Mar. 1, 2018

(51) Int. Cl.
*F22G 5/12* (2006.01)
*B05B 1/30* (2006.01)
(Continued)

(52) U.S. Cl.
CPC ..... *F22G 5/123* (2013.01); *B01F 3/04056* (2013.01); *B05B 1/14* (2013.01);
(Continued)

(58) Field of Classification Search
CPC ..... B05B 1/1609; B05B 1/304; B05B 1/323; B05B 1/14; B05B 1/16; B05B 1/3006;
(Continued)

(56) References Cited

U.S. PATENT DOCUMENTS 1,876,980 A * 9/1932 Lentell, Jr. ..... F02M 61/08 239/466
2,063,709 A * 12/1936 Taylor ..... F02M 61/08 239/453
(Continued)

FOREIGN PATENT DOCUMENTS

DE 102007054673 A1 * 5/2009 ..... B05B 1/1609
EP 0501164 A1 9/1992
(Continued)

OTHER PUBLICATIONS

EPO translation of EP-2415533-A1 (Year: 2012).*
(Continued)

*Primary Examiner* — Stephen Hobson
(74) *Attorney, Agent, or Firm* — Marshall, Gerstein & Borun LLP

(57) ABSTRACT

A multi-cone, multi-stage spray nozzle includes a nozzle body, a valve stem with a first valve head, and a second valve head attached to the first valve head. The first valve stem is biased into a closed position against a valve seat of the nozzle body by a bias device. The second valve head is continuously open. Upon the application of a first fluid pressure, which is less than a threshold fluid pressure, the bias device maintains the valve stem in the closed position while the second valve head is continuously open. And upon the application of a second fluid pressure, which is at least as great as the threshold fluid pressure, the valve stem moves to an open position while the second valve head remains continuously open.

18 Claims, 3 Drawing Sheets

(51) Int. Cl.

| | |
|---|---|
| ***B05B 1/32*** | (2006.01) |
| ***B01F 3/04*** | (2006.01) |
| ***B05B 1/14*** | (2006.01) |
| *B05B 1/16* | (2006.01) |

(52) U.S. Cl.
CPC ..... *B05B 1/304* (2013.01); *B05B 1/323* (2013.01); *F22G 5/126* (2013.01); *B01F 2215/008* (2013.01); *B05B 1/16* (2013.01); *B05B 1/1609* (2013.01)

(58) Field of Classification Search
CPC ..... F22G 5/123; F22G 5/126; B01F 3/04056; B01F 2215/008; F28C 3/08
See application file for complete search history.

(56) References Cited

U.S. PATENT DOCUMENTS 2,127,188 A * 8/1938 Schellin ..... B05B 1/1609 239/440
2,313,994 A * 3/1943 Grant ..... B05B 1/1609 239/440
2,320,964 A * 6/1943 Yates ..... B08B 5/02 239/291
2,801,881 A * 8/1957 Campbell ..... F23D 11/26 239/464
3,737,105 A * 6/1973 Arnold ..... B05B 1/06 239/423
3,850,373 A * 11/1974 Grolitsch ..... B05B 3/02 239/499
4,197,997 A * 4/1980 Wu ..... F02M 45/086 239/102.1
4,512,520 A * 4/1985 Schoonover ..... B05B 1/265 239/440
4,958,771 A * 9/1990 Klomp ..... F02M 61/08 239/453
4,991,780 A * 2/1991 Kannan ..... B05B 1/323 239/440
5,357,914 A * 10/1994 Huff ..... F01L 1/285 123/790
5,862,992 A * 1/1999 Stinson ..... B01D 19/0015 239/440
6,729,351 B2 * 5/2004 Bircann ..... F16K 1/443 123/568.2
6,746,001 B1 * 6/2004 Sherikar ..... F22G 5/123 122/487
7,296,545 B2 * 11/2007 Ellingsen, Jr. ..... F01L 3/06 123/790
7,654,509 B2 * 2/2010 Freitas ..... B05B 1/3073 261/62
8,327,831 B2 * 12/2012 Sturman ..... F02D 17/026 123/525
8,800,895 B2 * 8/2014 Hicks ..... B05B 1/00 239/597
8,955,773 B2 * 2/2015 Watson ..... B05B 1/3073 239/439
9,631,855 B2 * 4/2017 Dodson ..... B05B 1/048
2008/0308064 A1 * 12/2008 Yudanov ..... F02M 63/0007 123/296
2010/0051728 A1 3/2010 Hicks
2012/0138710 A1 * 6/2012 Hicks ..... B05B 1/3415 239/455
2014/0091485 A1 * 4/2014 Watson ..... B05B 1/3073 261/66
2014/0252125 A1 * 9/2014 Mastrovito ..... B05B 1/3073 239/302
2016/0033124 A1 * 2/2016 Giove ..... B05B 1/3073 261/78.2

FOREIGN PATENT DOCUMENTS

EP 2415533 A1 * 2/2012 ..... B05B 1/323
WO WO-2013077849 A1 5/2013

OTHER PUBLICATIONS

EPO translation of DE-102007054673-A1 (Year: 2009).*
International Search Report and Written Opinion for International Application No. PCT/US2017/047880 dated Nov. 2, 2017.

* cited by examiner

MULTI-CONE, MULTI-STAGE SPRAY NOZZLE

FIELD OF THE DISCLOSURE

The present disclosure is related to spray nozzles and, more particularly, to spray nozzles for steam conditioning devices such as desuperheaters and steam conditioning valves.

BACKGROUND

Steam conditioning devices (e.g., desuperheaters and steam conditioning valves) are used in many industrial fluid and gas lines to reduce the temperature of superheated process fluid and gas to a desired set point temperature. For example, desuperheaters are used in power process industries to cool superheated steam. The desuperheater utilizes nozzles to inject a fine spray of atomized cooling water or other fluid, which can be referred to as a spraywater cloud, into the steam pipe through which the process steam flows. Evaporation of the water droplets in the spraywater cloud reduces the temperature of the process steam. The resulting temperature drop can be controlled by adjusting the characteristics of the spraywater cloud by adjusting one or more control variables, such as the flow rate, pressure and/or temperature of the cooling water being forced through the nozzles. But the adjustability of these control variables can be limited based on the mechanics of the nozzles themselves. For example, a nozzle equipped for high flow rate and/or high pressure conditions may not properly function at low flow rate and/or low pressure conditions. Thus, the operating range for any given set of nozzles must be considered when designing a steam conditioning device for any given application.

SUMMARY

One aspect of the present disclosure provides a spray nozzle including a nozzle body, a valve stem defining a first valve head, a fluid conduit, a second valve head, and a bias device. The nozzle body has a proximal end, a distal end, a first through bore extending between the proximal and distal ends of the nozzle body, and a valve seat disposed at the distal end of the nozzle body. The valve stem is slidably disposed in the first through bore of the nozzle body and includes a proximal end, a distal end, and a first valve head. The first valve head defines a seating surface adapted to engage the valve seat when the valve stem is in a closed position and adapted to be spaced away from the valve seat when the valve stem is in an open position. The fluid conduit is disposed in the valve stem and defines a fluid outlet in the first valve head at the distal end of the valve stem. The second valve head is attached to the fluid outlet at the valve head of the valve stem, and defines a nozzle opening that is continuously open in fluid communication with the fluid conduit in the valve stem. The bias device generates a force biasing the first valve head of the valve stem toward the valve seat of the nozzle body. Upon application of a first fluid pressure, which is less than a threshold fluid pressure, on the seating surface of the first valve head, the bias device maintains the valve stem in the closed position while the second valve head is continuously open. And, upon application of a second fluid pressure, which is at least as great as the threshold fluid pressure, on the seating surface of the first valve head, the valve stem moves from the closed position to the open position while the second valve head remains continuously open.

Another aspect of the present disclosure provides a steam conditioning device including a steam pipe and a plurality of spray nozzles connected to a manifold and mounted about the steam pipe. The plurality of spray nozzles are adapted to deliver cooling water flow into the steam pipe. Each spray nozzle includes a nozzle body, a valve stem defining a first valve head, a fluid conduit, a second valve head, and a bias device. The nozzle body has a proximal end, a distal end, a first through bore extending between the proximal and distal ends of the nozzle body, and a valve seat disposed at the distal end of the nozzle body. The valve stem is slidably disposed in the first through bore of the nozzle body and includes a proximal end, a distal end, and a first valve head. The first valve head defines a seating surface adapted to engage the valve seat when the valve stem is in a closed position and adapted to be spaced away from the valve seat when the valve stem is in an open position. The fluid conduit is disposed in the valve stem and defines a fluid outlet in the first valve head at the distal end of the valve stem. The second valve head is attached to the fluid outlet at the valve head of the valve stem, and defines a nozzle opening that is continuously open in fluid communication with the fluid conduit in the valve stem. The bias device generates a force biasing the first valve head of the valve stem toward the valve seat of the nozzle body. Upon application of a first fluid pressure, which is less than a threshold fluid pressure, on the seating surface of the first valve head, the bias device maintains the valve stem in the closed position while the second valve head is continuously open. And, upon application of a second fluid pressure, which is at least as great as the threshold fluid pressure, on the seating surface of the first valve head, the valve stem moves from the closed position to the open position while the second valve head remains continuously open.

In some aspects, the nozzle body includes a cylindrical wall defining the first through bore.

In some aspect, the bias device is disposed at the proximal end of the valve stem.

In some aspects, the bias device includes a nut attached to the proximal end of the valve stem and a spring disposed between the nut and the proximal end of the nozzle body.

In some aspects, the spring is disposed around the proximal end of the valve stem.

In some aspects, the proximal end of the nozzle body defines a shoulder surface, and when the valve stem is in the closed position the nut is spaced away from the shoulder surface, and when the valve stem is in the open position the nut is in contact with the shoulder surface.

In some aspects, the nozzle body, the valve stem, and the second valve head are coaxially aligned.

Some aspects further include a nozzle casing attached to the nozzle body and enclosing the proximal end the valve stem and enclosing the bias device.

In some aspects, the nozzle opening of the second valve head includes a fixed orifice diameter.

In some aspects, the fluid conduit in the valve stem includes a second through bore extending between the proximal and distal ends of the valve stem and defining a fluid inlet at the proximal end of the valve stem.

In some aspects, the fluid conduit includes a plurality of fluid conduits extending radially at an angle through the valve stem and including a corresponding plurality of fluid inlets in fluid communication with the fluid outlet.

DETAILED DESCRIPTION

The present disclosure is directed to a spray nozzle typically for use in steam conditioning applications such as desuperheaters and steam conditioning valves, for example, but other applications are contemplated. In the disclosed embodiments, the spray nozzle includes two or more operating stages for accommodating an increased range of cooling fluid operating pressures and flow rates through the nozzle. The two or more stages are achieved through the implementation of two or more valve heads with different operating sensitivities.

Figure 1:
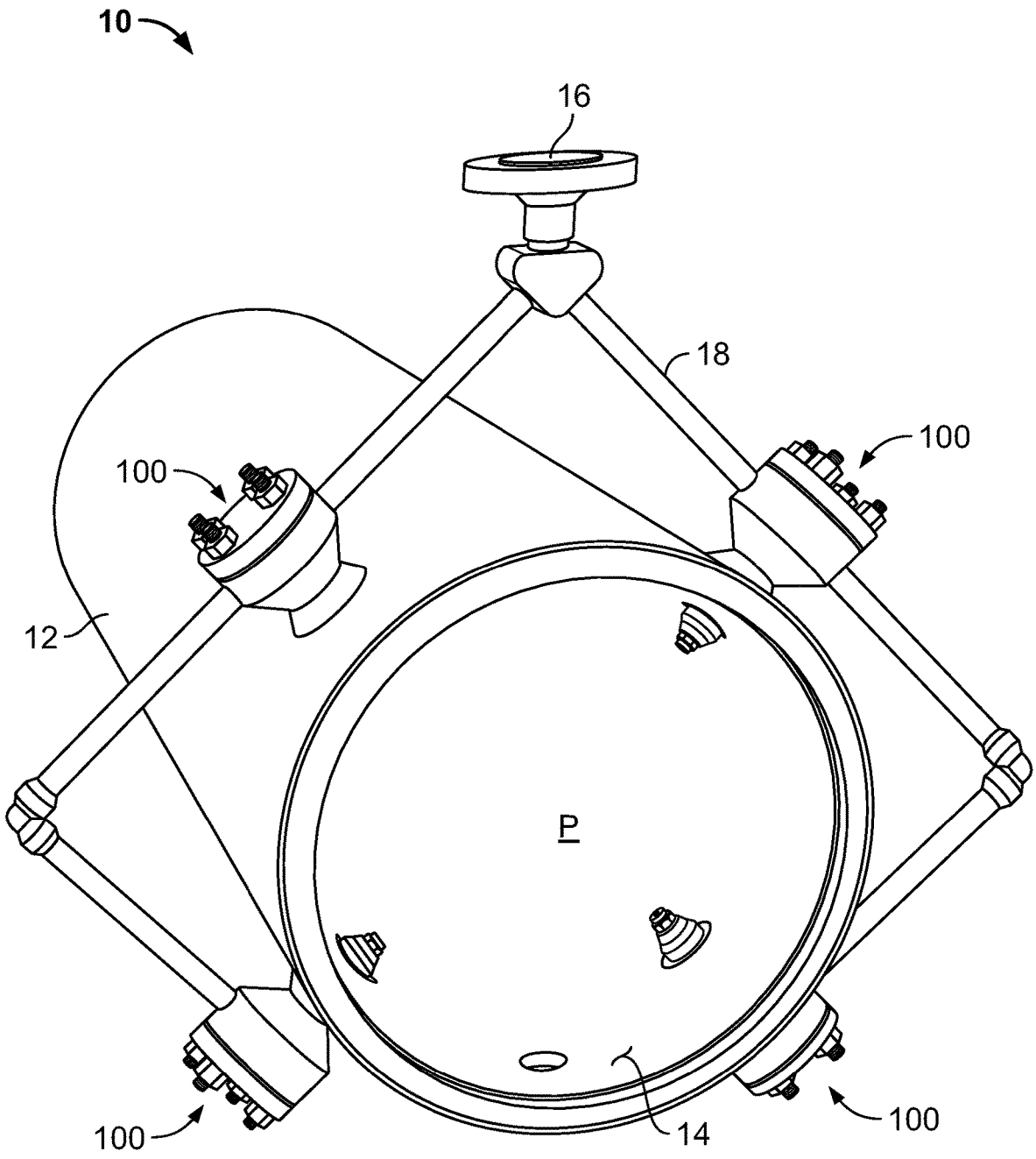
FIG. 1 is a perspective view of a steam pipe including a plurality of spray nozzles constructed in accordance with the teachings of the present disclosure.

FIG. 1 depicts a steam pipe 10 including a plurality of spray nozzles 100 constructed in accordance with the present disclosure. Generally, the steam pipe 10 can be used to reduce the temperature of superheated steam travelling therethrough to a desired set point temperature. By way of example only, the steam pipe 10 of FIG. 1 may be a portion of a desuperheater such as, for example, a Fisher® TBX-T desuperheater, a Fisher® TBX desuperheater, a Fisher® DMA/AF desuperheater, or a Fisher® DMA/AF-HTC desuperheater. In other examples, the steam pipe 10 of FIG. 1 may be a portion of a steam conditioning valve such as, for example, a Fisher® CVX steam conditioning valve. The steam pipe 10 generally comprises a hollow cylindrical wall 12, which in some applications can include a thermal liner 14, defining a steam flow path P. Also, as shown, the steam pipe 10 includes the plurality of spray nozzles 100, each fed with cooling fluid by a spraywater manifold 18 having a fluid inlet 16. In the disclosed version, the steam pipe 10 includes four (4) spray nozzles 100 spaced approximately 90° apart about the cylindrical wall 12. Other configurations are intended to be within the scope of the present disclosure. As mentioned, the spray nozzles 100 of the present disclosure are constructed to have a large range of operating pressures and flow rates such that the same steam pipe 10 can be used in a variety of different applications, having different operating demands, without having to replace the spray nozzles 100.

During operation, superheated steam or gas may flow along the flow path P in the steam pipe 10 at high temperatures ranging, for example, from approximately 1000° F. to approximately 1200° F. Depending on the temperature, composition and flow rate of the steam or gas, the amount and pressure of cooling fluid needed to reduce the temperature to the set point may vary. As such, the amount and pressure of cooling fluid passing through the spray nozzles 100 can vary for different applications and environments. For example, in certain circumstances, it may be necessary to have high pressure and high flow rates of cooling fluid passing through the spray nozzles 100, while in other circumstances low pressure and low flow rates are desired. The present disclosure advantageously provides a single spray nozzle that can work in both situations, serving a large range of operating conditions, while also providing a compact device with optimum useful life. Typical steam pressures range from very low pressures down to as low as approximately 5 psia (vacuum) up to perhaps 2500 psia or more. Cooling fluid pressures then are typically in the range of 50-500 psi greater than the steam pressure. Steam and water flow rates can vary even more widely depending on pipe size and pressure, as well as how much temperature reduction is desirable in the particular desuperheating application.

Figure 2:
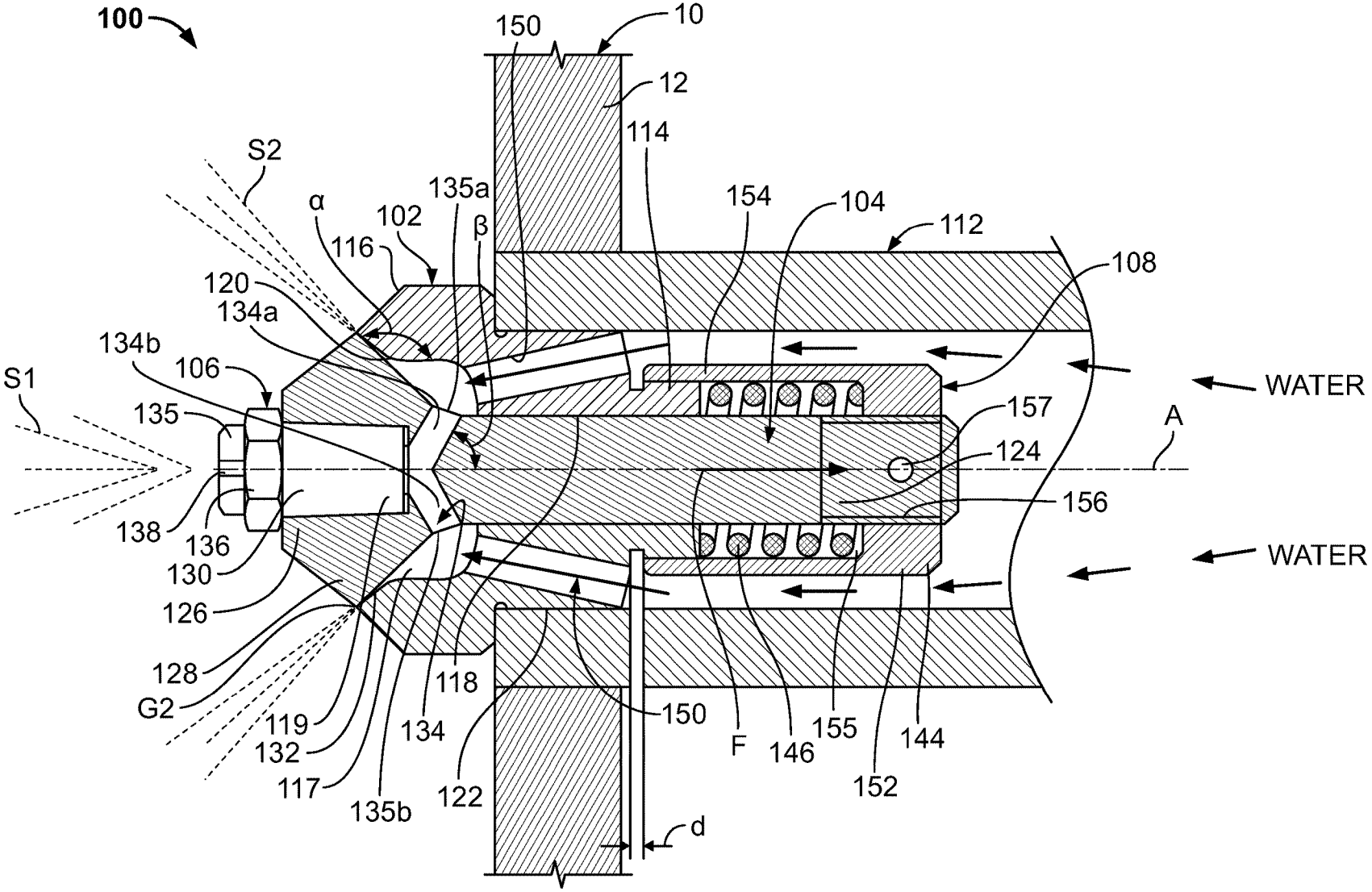
FIG. 2 is a cross-section of one version of a spray nozzle constructed in accordance with the teachings of the present disclosure.

FIG. 2 depicts a cross-section of one version of the spray nozzles 100, mounted to the cylindrical wall 12 of the steam pipe 10 of FIG. 1. As illustrated, the nozzle 100 includes a nozzle body 102, a valve stem 104 with a first valve head 128, a second valve head 106 mounted to the valve stem 104, a bias device 108, and a nozzle casing 112. The nozzle casing 112 is illustrated as being mounted in an aperture or opening in the cylindrical wall 12 of the steam pipe 10. This mounting may be accomplished with a threaded connection, a weld, friction fit, adhesive, or any other means.

The nozzle body 102 is a hollow generally cylindrical body including a proximal end 114, a distal end 116, a through bore 118, and a valve seat 120. The through bore 118 extends between the proximal and distal ends 114, 116 and includes an enlarged flow cavity 117 at the distal end 116. The valve seat 120 is disposed at the distal end 116 and includes an inner annular surface of the nozzle body 102 surrounding the enlarged flow cavity 117. In one version, the outer valve seat 120 includes a frustoconical surface extending at an angle a relative to a longitudinal axis A of the spray nozzle 100. The nozzle body 102 further includes a threaded region 122 disposed between the proximal and distal ends 114, 116 and threadably attached to the nozzle casing 112. So configured, the nozzle body 102 is fixed against axial displacement relative to the nozzle casing 112. The proximal end 114 of the nozzle body 102 is disposed inside the nozzle casing 112 and outside of the steam pipe 10. The distal end 116 of the nozzle body 102 is disposed outside of the nozzle casing 112 and inside of the steam pipe 10. In the disclosed embodiment, the threaded region 122 has a diameter that is large than a diameter of the proximal end 114 of the nozzle boy 102 and smaller than a diameter of the distal end 116 of the nozzle body 102. While the present version of the spray nozzle 100 has been described as including the nozzle casing 112, in other versions, the nozzle casing 112 may be considered a component of the spraywater manifold 18 or cylindrical wall 112 of the steam pipe 10. For example, in some embodiments, the nozzle casing 112 may be an integral part of the steam pipe 10 such that the nozzle body is threaded directly into the steam pipe 10.

Still referring to FIG. 2, the valve stem 104 is slidably disposed in the through bore 118 of the nozzle body 102 and includes an elongated member disposed on the longitudinal axis A. As such, the valve stem 104 is coaxially aligned with the nozzle body 102. More specifically, the valve stem 104 includes a proximal end 124, a distal end 126, the first valve head 128, and a fluid conduit 134. The fluid conduit 134 of the version disclosed in FIG. 2 includes a plurality of fluid conduits 134*a*, 134*b* that extend radially at an angle through the valve stem 104 and include a corresponding plurality of fluid inlets 135*a*, 135*b* on the radial sidewall of the valve stem 104. The fluid conduits 134*a*, 134*b* terminate into a fluid outlet 119 of the valve stem 104. Thus, the fluid inlets 135*a*, 135*b* are in fluid communication with the fluid outlet 119 of the valve stem 104 via the fluid conduits 134*a*, 134*b*.

As depicted, in this version, the plurality of fluid conduits 134*a*, 134*b* converge to the fluid outlet 119. The fluid outlet 119 is a cylindrical cavity formed in the first valve head 128 at the distal end 126 of the valve stem 104.

The first valve head 128 includes an enlarged portion defining a seating surface 132 for selectively seating against the valve seat 120 of the nozzle body 102. In some embodiments, to achieve a fluid tight seal, the seating surface 132 of the first valve head 128 of the valve stem 104 can be disposed at the same angle α as the outer valve seat 120. Thus, the seating surface 132 of the first valve head 128 is adapted to engage the valve seat 120 of the nozzle body 102 when the valve stem 104 is in a closed position (shown in FIG. 2) and is adapted to be spaced away from the valve seat 120 of the nozzle body 102 when the valve stem 104 is in an open position (not shown).

The second valve head 106, as mentioned, is mounted to the valve stem 104. More specifically, the second valve head 106 is mounted in the fluid outlet 119 of the first valve head 128 of the valve stem 104. In the disclosed version, the second valve head 106 includes a valve having a cylindrical valve body 130 fixedly mounted in the fluid outlet 119. The second valve head 106 further includes a nozzle 135 and a fastener 136 securing the nozzle 135 to the valve body 130. The nozzle 135 defines a nozzle opening 138. In the disclosed version of the second valve head 106, the nozzle opening 138 is continuously and constantly open and in constand fluid communication with the fluid outlet 119 and fluid conduit 134 of the valve stem 104. In some embodiments, the second valve head 106 can include a fixed geometry design such as the model M or BD spray nozzles, which are commercially available from Spraying Systems Co., Wheaton, Ill. USA.

As mentioned above, the spray nozzle 100 of the present disclosure further includes a bias device 108. In the disclosed embodiment, the bias device 108 biases the valve stem 104 into its closed position shown in FIG. 2. That is, the bias device 108 generates a force F biasing the seating surface 132 of the first valve head 126 of the valve stem 104 toward the valve seat 120 of the nozzle body 102. In the disclosed version of the spray nozzle 100, the bias device 108 is located at the proximal end 124 of the valve stem 104. And, as such, the bias device 108 is located inside of the nozzle casing 112. So configured, during use the bias device 108 is only exposed to the cooling fluid flowing through the spray nozzle 100, which in the disclosed version is via the nozzle casing 112 and spraywater manifold 18. This advantageously maintains the bias device 108 at a temperature consistent with the cooling fluid which is within the normal operating range for the materials used. This optimizes the useful life of the bias device 108 because exposure to high temperatures, such as those inside of the stem pipe 10, can degrade the integrity and strength of the components of the bias device 108.

With continued reference to FIG. 2, the disclosed version of the bias device 108 includes a nut 144 and a spring 146. The spring 146 can be disposed about or around the proximal end 124 of the valve stem 104. The nut 144 is a hollow tubular member including a collar portion 154 and a shoulder portion 152 having threads 156 threadably coupled to the proximal end 124 of the valve stem 104. Additionally, the depicted version of the bias device 108 further includes a stop pin 157 extending through and coupling the nut 144 to the proximal end 124 of the valve stem 104. The stop pin 157 can therefore prevent relative rotation of the nut 144 and the valve stem 104, which can change the axial location of the nut 144. The collar portion 154 defines an annular recess 155 in which the spring 146 resides at a location compressed between the proximal end 114 of the nozzle body 102 and the shoulder portion 152 of the nut 144. Thus, in the depicted version, the compressed spring 146 exerts the force F by bearing against the fixed nozzle body 102 to push the nut 144 and therefore the valve stem 104 that is fixed to the nut 144 away from the nozzle body 102 (i.e., to the right relative to the orientation of FIG. 2).

In the disclosed spray nozzle 100, the second valve head 106 is always open, while the first valve head 128 is biased closed by the bias device 108. Thus, the first valve head 128 only opens upon the application of a pressure sufficient to overcome a threshold pressure set by the bias device 108. The relationship between the open second valve head 106 and the first valve head 128, therefore, facilitates the intended two-stage operation of the disclosed spray nozzle 100.

During operation, the spray nozzle 100 of FIG. 2 has two operating states or stages—a first open stage and a second open stage. FIG. 2 depicts the first open stage wherein the second valve head 106 is constantly open, and the first valve head 128 is closed. That is, the seating surface 132 of the first valve head 128 of the valve stem 104 is closed and sealingly engaged against the outer valve seat 120 of the nozzle body 102 by way of the force F generated by the bias device 108. In this configuration, cooling fluid pressurized within the nozzle casing 112 passes into the flow cavity 117 of the nozzle body 102 via a plurality of bypass conduits 150 formed in the proximal end 116 of the nozzle body 102. Some of that fluid then passed out of the nozzle 135 of the second valve head 106 via the plurality of fluid conduits 134*a*, 134*b* in the valve stem 104. The fluid pressure remaining in the flow cavity 117 bears against the exposed backside of the seating surface 132 of the first valve head 128, but does not create sufficient force to move the valve stem 104 against the bias of the spring 146 of the bias device 108. Therefore, the cooling fluid can pass through the second valve head 106 to emit a first cone of spray S1, but cannot pass between the first valve head 128 and nozzle body 102. It can be said that in the first open stage, the pressure of the cooling fluid in the nozzle casing 112 is less than a threshold pressure set by the force F generated by the bias device 108 and holding the first valve head 128 in the closed position. This arrangement may be useful in situations where the cooling fluid is supplied at a low pressure and/or low flow rate, for example.

As the pressure of the cooling fluid in the nozzle casing 112 increases, the spray nozzle 100 can operate in a second open stage. In the second open stage, cooling fluid in the nozzle casing 112 can be pressurized to a second pressure that is at least as great as the threshold pressure set by the bias device 108. Same as described above, the cooling fluid is ultimately supplied to the flow cavity 117 in the nozzle body 102 by way of the bypass conduits 150. Some of that fluid naturally passes out of the second valve head 106 to emit the first cone of spray S1. The remaining portion bears against the exposed backside of the seating surface 132 of the outer valve stem 104. Once the pressure in the flow cavity 117 reaches the threshold pressure, it urges the valve stem 104 toward the nozzle body 102 such that the seating surface 132 of the first valve head 128 moves away from the valve seat 120 to open the first valve head 128. This second open stage therefore is advantageous when high pressure and high flow rates of cooling fluid are desired.

As shown in FIG. 2, when the valve stem 104 occupies the closed position, the nut 144 of the bias device 108 coupled to the proximal end 124 of the valve stem 104 is spaced from the nozzle body 102 by a distance d. But, as the pressure builds in the nozzle casing 112 and the valve stem 104 moves toward the nozzle body 102, the nut 144 makes contact with the proximal end 116 of the nozzle boy 102. As such, the nozzle body 102 acts as a stop limiting movement of the valve stem 104 when reaching the maximum open position. In any open position, a second cone of spray S2 is emitted from a gap G between the seating surface 132 of the first valve head 128 and the valve seat 120 of the nozzle body 102. It should be appreciated that in FIG. 2, the first valve head 128 is depicted in the closed position, but the second cone of spray S2 and gap G are identified for illustration only. As should be appreciated from the foregoing description, the second valve head 106 also moves with the valve stem 104 as it moves from the closed position to the maximum open position by virtue of the fact that it is fixed inside of the fluid outlet 119 in the first valve head 128. However, this movement of the second valve head 106 is not relative to the first valve head 128 or valve stem 104 and has no impact on its performance.

As discussed above, in order for the cooling fluid supplied in the nozzle casing 112 to reach the second valve head 106, it must pass through the bypass conduits 150 in the nozzle body 102, the flow cavity 117 in the nozzle body 102, the fluid conduits 134*a*, 134*b* in the valve stem 104, and finally the fluid outlet 119. Variations on this design, however, are intended to be within the scope of the disclosure.

Figure 3:
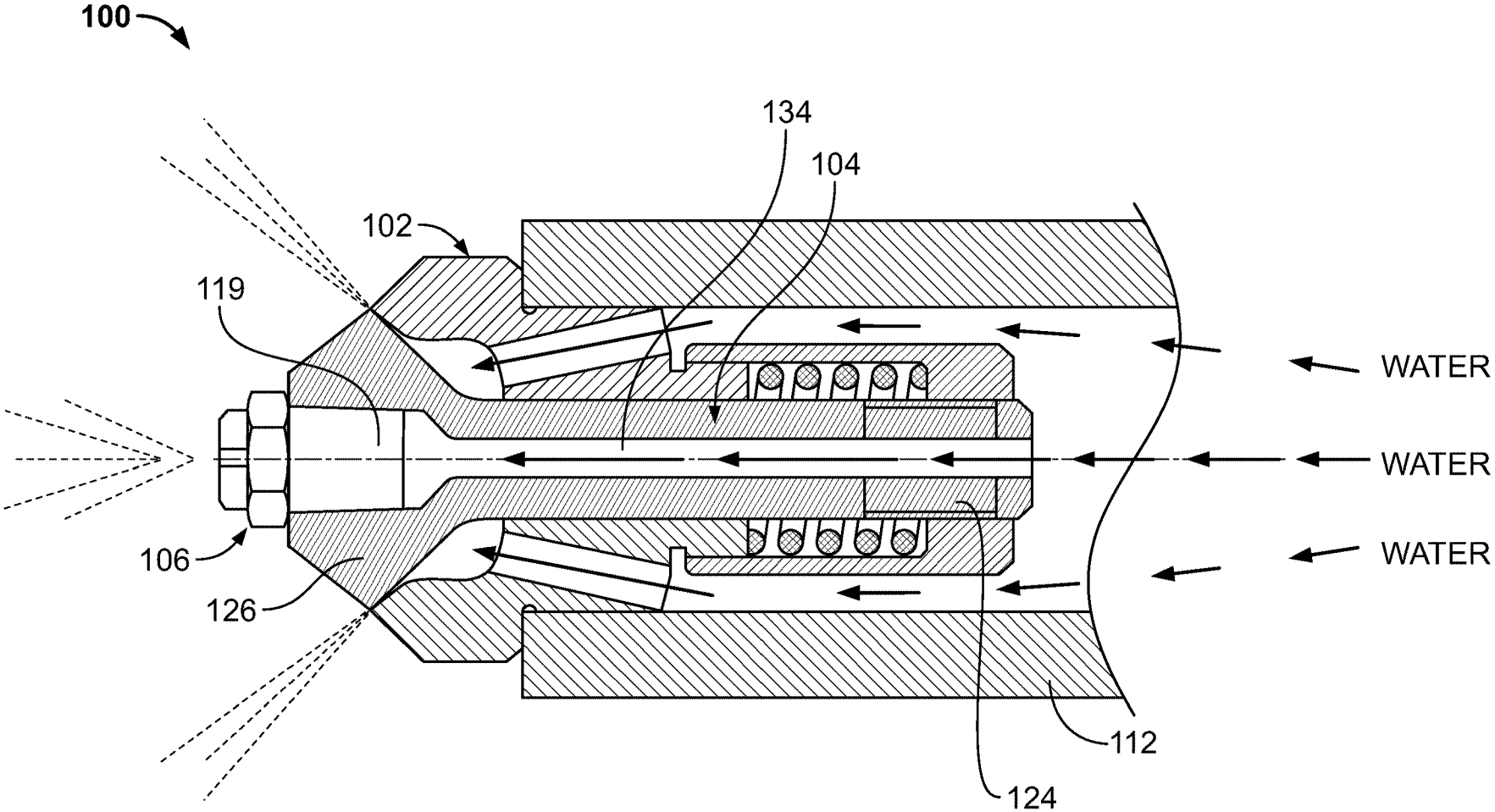
FIG. 3 is a cross-section of another version of a spray nozzle constructed in accordance with the teachings of the present disclosure.

FIG. 3 depicts an alternative spray nozzle 100 constructed in accordance with the principles of the present disclosure. In FIG. 3, the spray nozzle 100 is substantially identical to the spray nozzle 100 in FIG. 2 but for the flow path of cooling fluid between the nozzle casing 112 and the second valve head 106. Specifically, in FIG. 3, the valve stem 104 includes a single fluid conduit 134 enabling direct fluid communication between the nozzle casing 112 and the second valve head 106. The fluid conduit 134 in FIG. 3 extends along the longitudinal axis A between the proximal and distal ends 124, 126 of the valve stem 104 and in direct communication with the fluid outlet 119, which in turn is in direct communication with the second valve head 106. Another distinction is that the spray nozzle in FIG. 3 is not shown as including the lock pin 157 passing through the nut 144 and valve stem 104. But in some versions, the lock pin 157 can be included in FIG. 3 as well. When the lock pin 157 is included, it could be desirable to offset the lock pin 157 from center of the valve stem 104 such as not to interfere with the flow of fluid through the fluid conduit 134. All other structural and functional features of the spray nozzle 100 in FIG. 3 are the same as the spray nozzle 100 in FIG. 2 and as such will not be repeated. One advantage of the arrangement in FIG. 3 may be that the nozzle 135 of the second valve head 106 is in direct fluid communication with the pressurized fluid in the nozzle casing 112 by way of the single fluid conduit 134 through the valve stem 140, which can ensure that the cooling fluid reaches the second valve head 106 without experiencing interruption or fluid flow disturbances that could occur in the fluid cavity 117 of the embodiment disclosed with reference to FIG. 2.

Based on the foregoing, the present disclosure provides a spray nozzle that can operate in a first open stage at low pressures and low flow rates, and operate at a second stage at high pressures and high flow rates, which advantageously increases the total range of pressures and flow rates over known spray nozzles in similar applications. Moreover, the present disclosure provides a very simple and compact design with an optimal useful life. That is, because the bias device is located only in the cooling fluid flow path, it is not exposed to the superheated temperatures resident in the steam pipe which can degrade and weaken the bias device components. Furthermore, in some embodiments, the bias device is of very simple construction, consisting only of nut and spring attached to the proximal end of the valve stem. This minimum number of components allows the overall axial and radial dimension of the spray nozzle to be minimized which facilitates handling, reduces material costs, and reduces the overall size of the steam pipe or other steam conditioning device to which the nozzles are attached.

As mentioned above in relation to FIG. 1, a steam pipe 10 constructed in accordance with the present disclosure can include a plurality of spray nozzles 100. In one embodiment, each of the spray nozzles 100 attached to the cylindrical wall 12 can have second valve heads 106 with the same size nozzle openings 138. But in other versions, the spray nozzles 100 can have second valve heads 106 with different size nozzle openings 138 to achieve a different pattern of cooling fluid flow into the steam pipe 10.

Further, while the spray nozzles 100 described herein include only a single second valve head 106 mounted in the valve stem 104, in some versions the valve stem 104 may be of sufficient diameter to include a plurality of second valve heads 106 mounted therein. And, while FIGS. 2 and 3 generally illustrate the first and second cones of spray S1, S2 being directed in the same direction—i.e., along the longitudinal axis A—other versions of the spray nozzles can have the cones of spray S1, S2 emitting in different directions, for example, at different angles relative to the longitudinal axis A.

Finally, based on the foregoing it should be appreciated that the scope of the present disclosure is not limited to the specific examples disclosed herein and a variety of changes and modifications can be useful depending on a desired end application and such changes and modifications are intended to be within the scope of the disclosure. Accordingly, the scope of the invention is not to be defined by the examples discussed herein and shown in the attached figures, but rather, the claims that are ultimately issued in a patent and all equivalents thereof.

What is claimed:

1. A spray nozzle, comprising:

a nozzle body having a proximal end, a distal end, a first through bore extending between the proximal and distal ends of the nozzle body, and a valve seat disposed at the distal end of the nozzle body, the proximal end of the nozzle body defining a shoulder surface;

a valve stem slidably disposed in the first through bore of the nozzle body and including a proximal end, a distal end, and a first valve head, the first valve head defining a seating surface adapted to engage the valve seat when the valve stem is in a closed position and adapted to be spaced away from the valve seat when the valve stem is in an open position;

a fluid conduit disposed in the valve stem and defining a fluid outlet in the first valve head at the distal end of the valve stem; and a second valve head attached to the fluid outlet at the valve head of the valve stem, the second valve head defining a nozzle opening that is continuously open in fluid communication with the fluid conduit in the valve stem; and a bias device generating a force biasing the first valve head of the valve stem toward the valve seat of the nozzle body, the bias device comprising a nut attached to the proximal end of the valve stem and a spring disposed between the nut and the proximal end of the nozzle body, wherein the nut comprises a hollow tubular member including a collar portion defining an annular recess to at least partially accommodate the spring, wherein upon application of a first fluid pressure, which is less than a threshold fluid pressure, on the seating surface of the first valve head, the bias device maintains the valve stem in the closed position while the second valve head is continuously open, upon application of a second fluid pressure, which is at least as great as the threshold fluid pressure, on the seating surface of the first valve head, the valve stem moves from the closed position to the open position while the second valve head remains continuously open, and when the valve stem is in the closed position, the collar portion of the nut is spaced away from the shoulder surface of the proximal end of the nozzle body, and when the valve stem is in the open position, the collar portion of the nut is in contact with the shoulder surface of the proximal end of the nozzle body.

2. The spray nozzle of claim 1, wherein the nozzle body comprises a cylindrical wall defining the first through bore.

3. The spray nozzle of claim 1, wherein the bias device is disposed at the proximal end of the valve stem.

4. The spray nozzle of claim 1, wherein the spring is disposed around the proximal end of the valve stem.

5. The spray nozzle of claim 1, wherein the nozzle body, the valve stem, and the second valve head are coaxially aligned.

6. The spray nozzle of claim 1, further comprising a nozzle casing attached to the nozzle body and enclosing the proximal end the valve stem and enclosing the bias device.

7. The spray nozzle of claim 1, wherein the nozzle opening of the second valve head comprises a fixed orifice diameter.

8. The spray nozzle of claim 1, wherein the fluid conduit in the valve stem comprises a second through bore extending between the proximal and distal ends of the valve stem and defining a fluid inlet at the proximal end of the valve stem.

9. The spray nozzle of claim 1, wherein the fluid conduit comprises a plurality of fluid conduits extending radially at an angle through the valve stem and including a corresponding plurality of fluid inlets in fluid communication with the fluid outlet.

10. A steam conditioning device, comprising:

a steam pipe;

a plurality of spray nozzles connected to a manifold and mounted about the steam pipe, the plurality of spray nozzles adapted to deliver cooling water flow into the steam pipe, each spray nozzle comprising:

a nozzle body having a proximal end, a distal end, a first through bore extending between the proximal and distal ends of the nozzle body, and a valve seat disposed at the distal end of the nozzle body, the proximal end of the nozzle body defining a shoulder surface;

a valve stem slidably disposed in the first through bore of the nozzle body and including a proximal end, a distal end, and a first valve head, the first valve head defining a seating surface adapted to engage the valve seat when the valve stem is in a closed position and adapted to be spaced away from the valve seat when the valve stem is in an open position;

a fluid conduit disposed in the valve stem and defining a fluid outlet in the first valve head at the distal end of the valve stem; and a second valve head attached to the fluid outlet at the valve head of the valve stem, the second valve head defining a nozzle opening that is continuously open in fluid communication with the fluid conduit in the valve stem; and a bias device generating a force biasing the first valve head of the valve stem toward the valve seat of the nozzle body, the bias device comprising a nut attached to the proximal end of the valve stem and a spring disposed between the nut and the proximal end of the nozzle body, wherein the nut comprises a hollow tubular member including a collar portion defining an annular recess to at least partially accommodate the spring, wherein upon application of a first fluid pressure, which is less than a threshold fluid pressure, on the seating surface of the first valve head, the bias device maintains the valve stem in the closed position while the second valve head is continuously open, upon application of a second fluid pressure, which is at least as great as the threshold fluid pressure, on the seating surface of the first valve head, the valve stem moves from the closed position to the open position while the second valve head remains continuously open, and when the valve stem is in the closed position, the collar portion of the nut is spaced away from the shoulder surface of the proximal end of the nozzle body, and when the valve stem is in the open position, the collar portion of the nut is in contact with the shoulder surface of the proximal end of the nozzle body.

11. The steam conditioning device of claim 10, wherein the nozzle body comprises a cylindrical wall defining the first through bore.

12. The steam conditioning device of claim 10, wherein the bias device is disposed at the proximal end of the valve stem.

13. The steam conditioning device of claim 10, wherein the spring is disposed around the proximal end of the valve stem.

14. The steam conditioning device of claim 10, wherein the nozzle body, the valve stem, and the second valve head are coaxially aligned.

15. The steam conditioning device of claim 10, further comprising a nozzle casing attached to the nozzle body and enclosing the proximal end the valve stem and enclosing the bias device.

16. The steam conditioning device of claim 10, wherein the nozzle opening of the second valve head comprises a fixed orifice diameter.

17. The steam conditioning device of claim 10, wherein the fluid conduit in the valve stem comprises a second through bore extending between the proximal and distal ends of the valve stem and defining a fluid inlet at the proximal end of the valve stem.

18. The steam conditioning device of claim 10, wherein the fluid conduit comprises a plurality of fluid conduits extending radially at an angle through the valve stem and including a corresponding plurality of fluid inlets in fluid communication with the fluid outlet.

* * * * *